United States Patent [19]

Yangas

[11] Patent Number: 4,877,933

[45] **Date of Patent: * Oct. 31, 1989**

[54] METHOD AND APPARATUS FOR CONTROLLING DISTRIBUTION AND POWER WITHIN THE CELLS OF A DEVICE FOR PROMOTING THE UNIFORM HEATING OF A FOOD PRODUCT IN A RADIANT ENERGY FIELD

[76] Inventor: Roger A. Yangas, 14000 Citation Dr., Orland Park, Ill. 60642

[ * ] Notice: The portion of the term of this patent subsequent to Sep. 13, 2005 has been disclaimed.

[21] Appl. No.: 144,520

[22] Filed: Jan. 15, 1988

Related U.S. Application Data

[63] Continuation-in-part of Ser. No. 19,216, Feb. 26, 1987, Pat. No. 4,771,155, which is a continuation-in-part of Ser. No. 765,374, Aug. 14, 1985, Pat. No. 4,683,362.

[51] Int. Cl.[4] ..... H05B 6/74

[52] U.S. Cl. ..... 219/10.55 M; 219/10.55 E; 219/10.55 F; 99/DIG. 14; 426/243

[58] Field of Search ..... 219/10.55 F, 10.55 E, 219/10.55 R, 10.55 M, 339, 341, 342, 346, 347, 348, 349; 426/234, 241, 243; 99/DIG. 14, 451; 126/451, 438, 439

[56] References Cited

U.S. PATENT DOCUMENTS

| | | | |
|---|---|---|---|
| 3,316,380 | 4/1967 | Pansing | 219/10.55 E |
| 3,461,260 | 8/1969 | Bremer | 219/10.55 F |
| 3,938,497 | 2/1976 | Andrassy | 126/451 |
| 3,982,527 | 9/1976 | Cheng et al. | 126/438 |
| 4,144,435 | 3/1979 | Clark et al. | 219/10.55 E |
| 4,228,334 | 10/1980 | Clark et al. | 219/10.55 E |
| 4,446,854 | 5/1984 | Clevett et al. | 126/451 |
| 4,499,356 | 2/1985 | Hatagawa | 219/10.55 E |
| 4,539,454 | 9/1985 | Yangas | 219/10.55 F |
| 4,585,915 | 4/1986 | Moore | 219/10.55 E |
| 4,683,362 | 7/1987 | Yangas | 219/10.55 F |
| 4,771,155 | 9/1988 | Yangas | 219/10.55 F |

*Primary Examiner*—Philip H. Leung

*Attorney, Agent, or Firm*—Silverman, Cass & Singer, Ltd.

[57] ABSTRACT

An apparatus and method for heating a food product in the presence of a radiant energy source includes a collector having a plurality of radiant energy reflective cells enclosed in a radiant energy transparent material. The cells are formed by a number of tabs that collect the radiant energy incident on the collectors and form a radiant energy field to uniformly heat the food product. The tabs can be manufactured from a material having a graduated thickness or gradient. The distribution of power within the collector cells is controlled by varying the number or size of the cells as well as the shape, angle or position of the tabs physically or automatically. The cells can be formed on a ceramic substrate, which can include a ferrite like coating, such as tin oxide.

37 Claims, 6 Drawing Sheets

FIG. 1
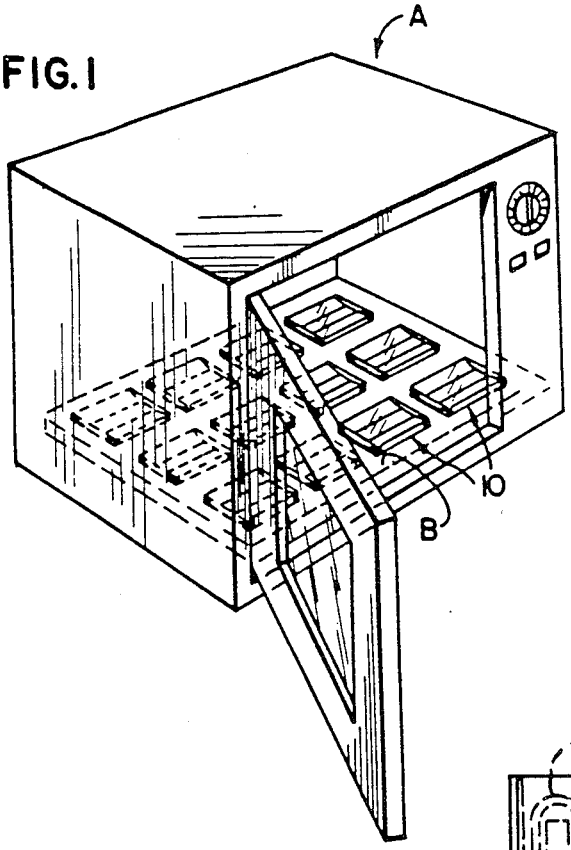
FIG. 2
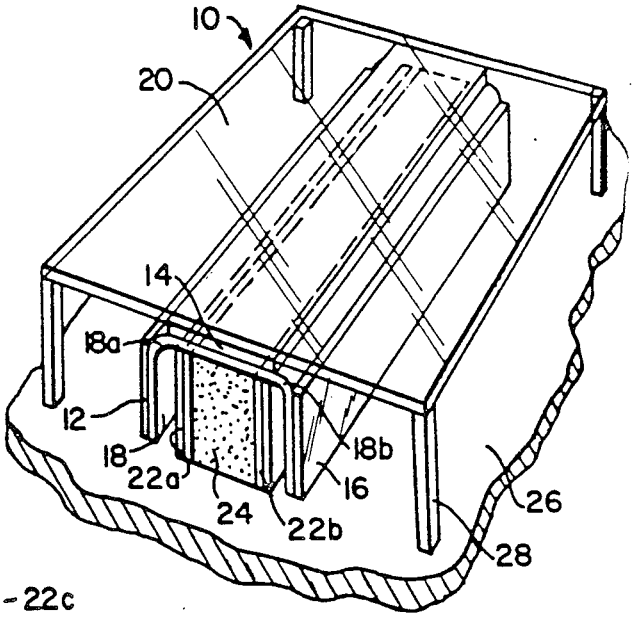
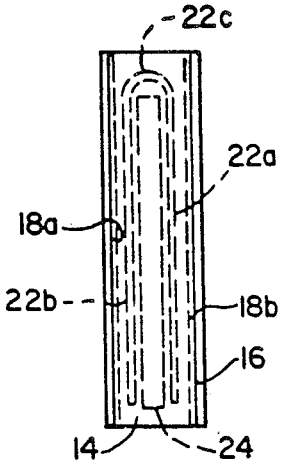
FIG. 3
FIG. 4A
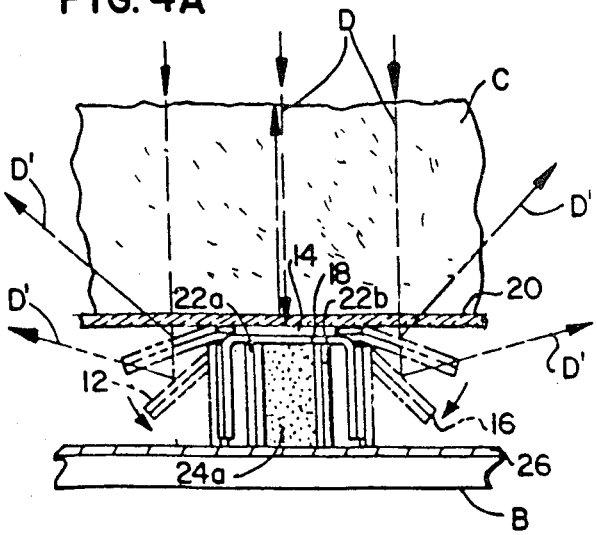
FIG. 4B
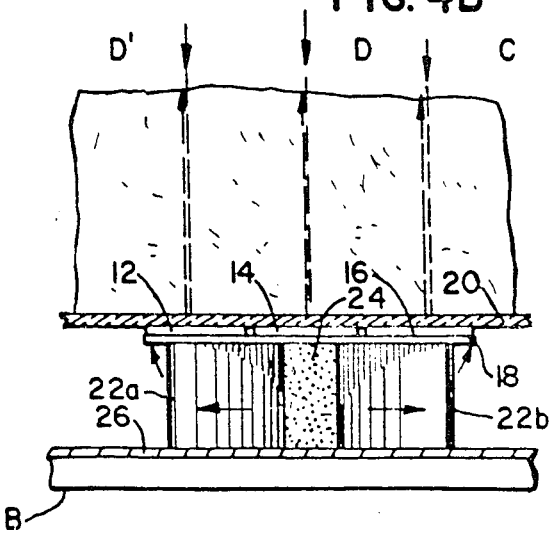

FIG. 5A
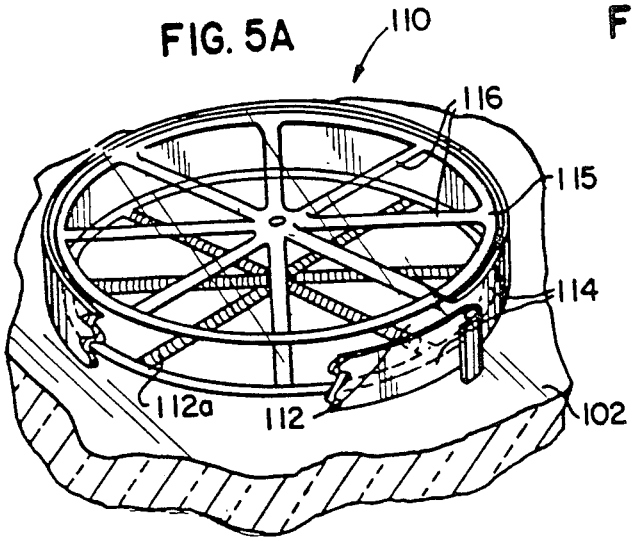
FIG. 5B
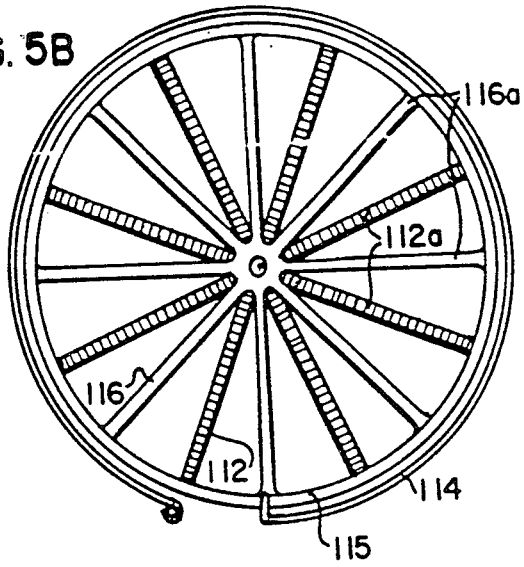
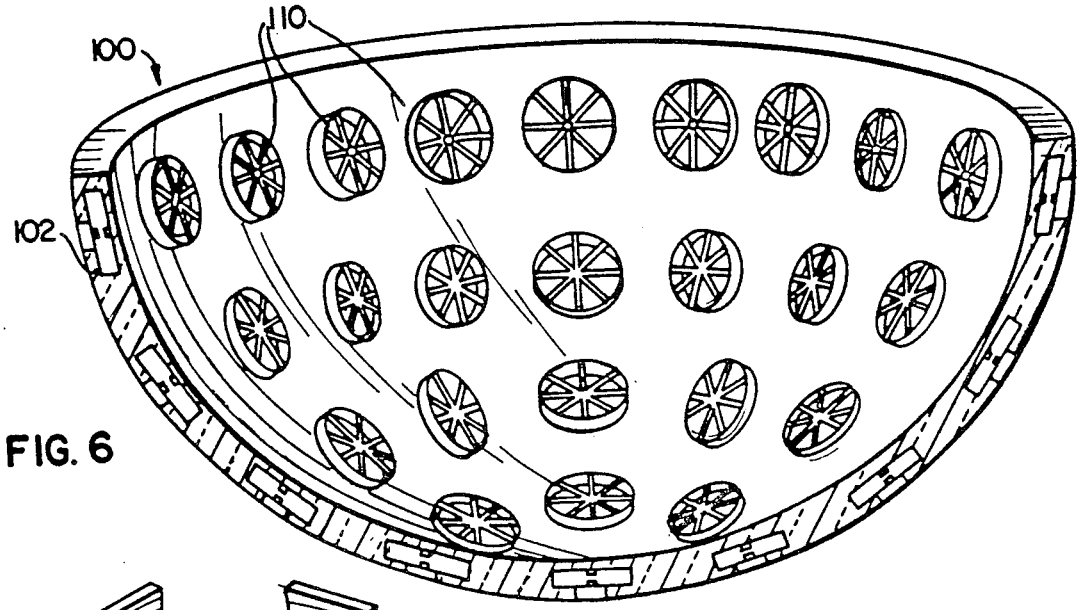
FIG. 6
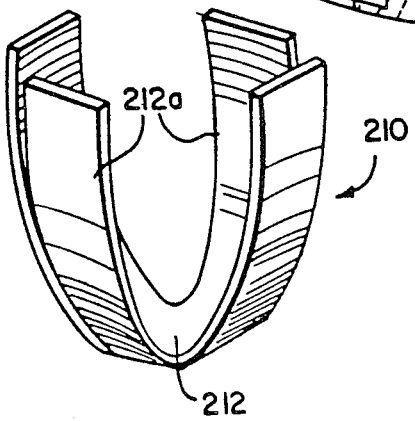
FIG. 7A
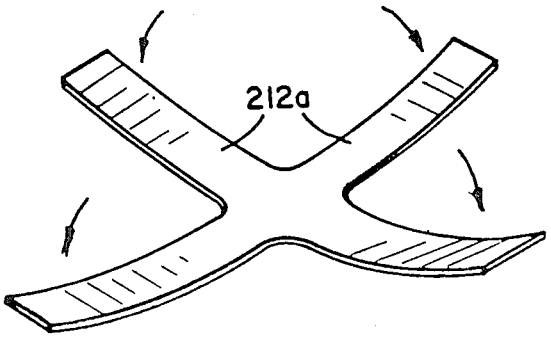
FIG. 7B FIG. 19
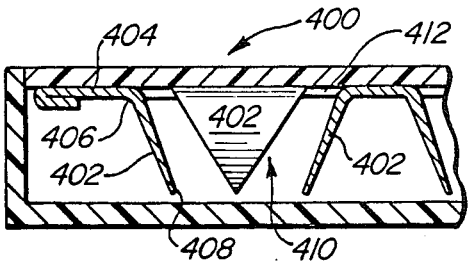
FIG. 20C
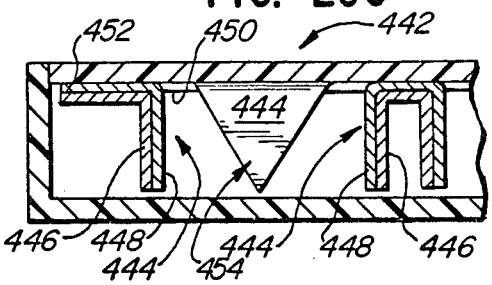
FIG. 20A
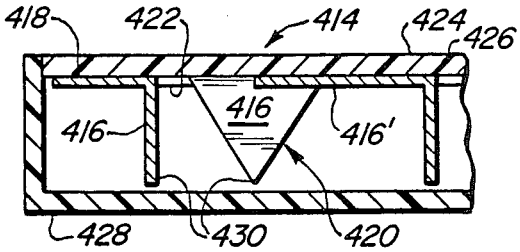
FIG. 20B
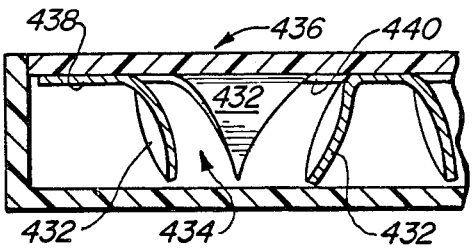
FIG. 20D
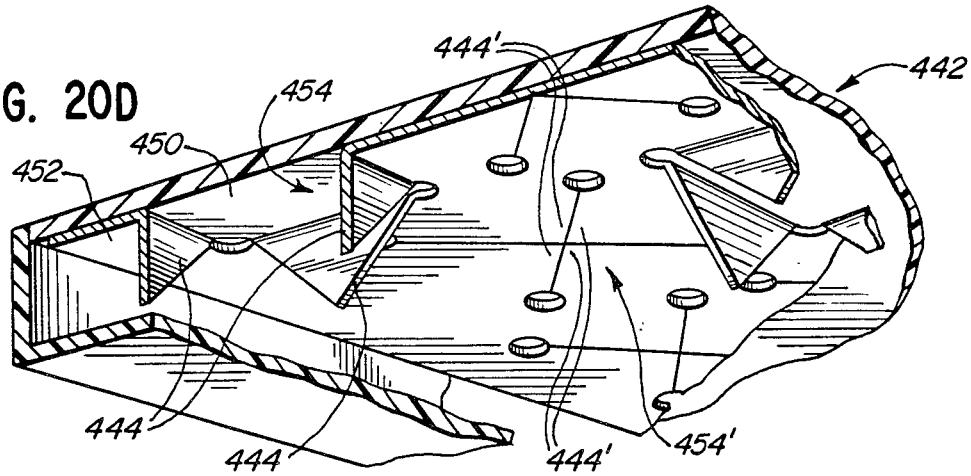
FIG. 22
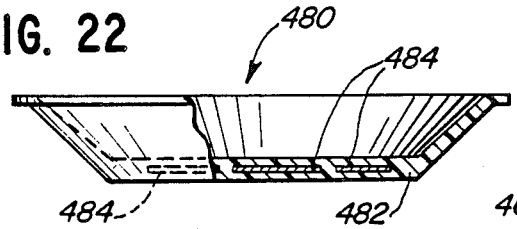
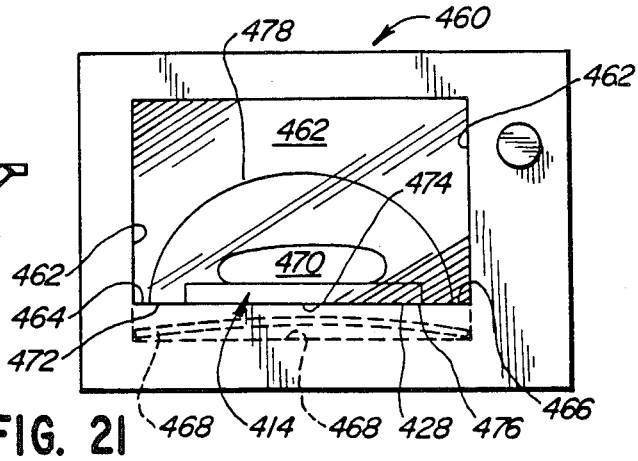
FIG. 21

FIG. 23
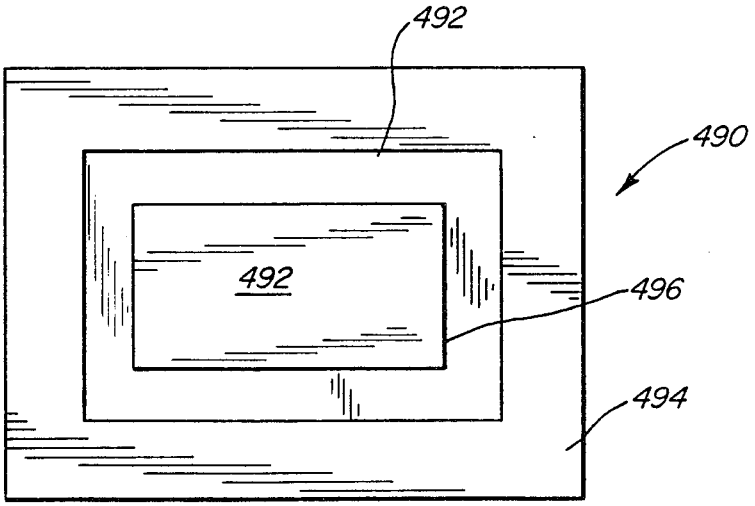
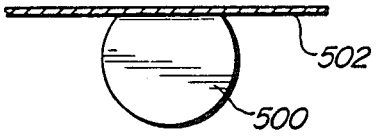
FIG. 24A
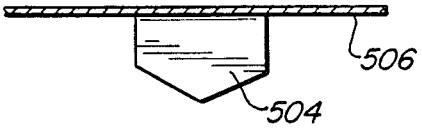
FIG. 24B

METHOD AND APPARATUS FOR CONTROLLING DISTRIBUTION AND POWER WITHIN THE CELLS OF A DEVICE FOR PROMOTING THE UNIFORM HEATING OF A FOOD PRODUCT IN A RADIANT ENERGY FIELD

CROSS-REFERENCE TO RELATED APPLICATIONS

This application is a continuation-in-part of prior pending application, U.S. Ser. No. 019,216 filed Feb. 26, 1987, U.S. Pat. No. 4,771,155 which is a continuation-in-part of U.S. Ser. No. 765,374 filed Aug. 14, 1985, now U.S. Pat. No. 4,683,362, the disclosures of which are incorporated herein by reference.

BACKGROUND OF THE INVENTION

This invention relates to improvements in the cooking of a food product in the presence of a radiant energy source and, more particularly to a method and apparatus for controlling distribution and power within the cells of a device for promoting the uniform heating of a food product in a radiant energy field.

The use of radiant energy for cooking, particularly in connection with a microwave oven, has become widespread in recent years. An estimated 66% of the 88 million American households now have microwave ovens and, in the post World War II period, microwaves have been the fastest growing appliance tracked by the Association of Home Appliance Manufacturers. Microwave cooking has reached this level of popularity primarily because food products can be heated quickly and conveniently without the inconvenience of a lengthy meal preparation. The energy in a microwave oven, however, is not distributed equally throughout the cavity of the oven and this unequal distribution causes some areas in the oven to be warmer than others. As a consequence, the food product or products in those areas become hotter resulting in significant temperature differences between separate portions of the food products or within a single portion of a food product.

Many attempts have been made to equalize microwave heating of food products. For example, stirring reduces the unequal heating effects, but there are many food products that cannot easily be stirred. Rearranging, or rotating, the food product within the oven cavity also can reduce the unequal heating effects, but the food product generally must be moved often to cook even substantially uniformly, a procedure that greatly reduces the convenience aspect of microwave cooking. Automatic devices to rotate the food products have been provided, but are not totally successful and add complexity and cost to the microwave units.

Reflective cells, as in parent application Ser. No. 765,374, provide movable reflectors for reflecting the microwaves. The reflectors are movable with variations in the response of a temperature sensor, so that the reflectors vary the direction of the reflected microwaves relative to the food product and vary the concentration of the reflective microwaves incident on the food product to promote uniform heating.

Parent application Ser. No. 019,216 provides a simplified device for the uniform heating of a food product that can be utilized in connection with a conventional radiant energy source such as a microwave oven. The device also can be utilized in connection with a commercial conveyor belt system wherein the food product is placed on the trays of the device, and the trays are thereafter passed through a radiant field. This conveyor application is useful in a commercial cooking environment such as an institution or in the production of precooked food products.

The present invention provides a method nd apparatus to control distribution and power within the cells of a device such as parent application Ser. No. 019,216 for promoting the uniform heating of a food product in a radiant energy field.

SUMMARY OF THE INVENTION

The present invention provides a radiant energy collector that, in the presence of a radiant energy heating source, will distribute a distinct radiant energy field to promote the heating of a food product. A plurality of cells form a collector and a plurality of tabs form each individual cell. The collectors are enclosed in a radiant energy transparent encasing structure to protect the collectors and to provide a convenient method of handling the apparatus.

In one embodiment, the tabs are constructed of a material having a graduated thickness gauge or a gradient with the base of the tab having a thicker gauge than the tip. The thickness gradient provides a collector having an enhanced performance, but the tabs are not so fragile as to produce production problems.

The number or size of the cells as well as the shape, angle, and position of the tabs can be adjusted to accommodate a particular oven or to control the distribution and power within the cells. For example, when all of the tabs of a single cell are closed, the food product over that collector is shielded and will not cook at the same rate as the food product located over open collector cells of the apparatus. The tabs can be designed to be physically or automatically moved or adjusted.

Spacing of the collector cells away from the walls and floor of a microwave oven can be controlled to increase collector efficiency or to adjust the collector to a particular microwave oven. Further, the oven floor can be shaped to locate the radiant energy reflective areas of the floor closer to or farther from the collector cells to effect the distribution and power of the field formed by the cells in that particular oven.

Additionally, where specific food products, such as pies, do not heat uniformly and require prolonged heating to cook one or more portions of the food, a food container can be provided that has tab portions partially blocking the underlying cells. The blocking tab portions increase the field applied to adjacent portions of the food product and heat it at a faster rate so that the entire food product will uniformly heat, such as the center of a pie. The most uniform collector heating performance is achieved by covering all of the food product or products within a dome or cover member.

Forming the cells on a ceramic substrate further enhances the operation of the collectors. The collectors should be spaced from the side walls of a microwave unit for maximum efficiency and the ceramic plate can be spaced from the side walls by a high temperature plastic border. Further, the cooling surface of the ceramic substrate above the cells can be further enhanced by a thin ferrite like coating such as indium tin oxide.

BRIEF DESCRIPTION OF THE DRAWINGS

FIGS. 1–7B are directed to the cells of parent application Ser. No. 765,374 with FIG. 1 illustrating a perspective view of a microwave oven within which an embodiment of the reflective cells of the parent application are installed;

FIG. 2 is an enlarged perspective view of one of the cells in FIG. 1, illustrating microwave reflecting elements movable by a bimetallic element;

FIG. 3 is plan view of the cell of FIG. 2 illustrating the U-shape of the bimetallic element;

FIG. 4A is an end view, partially in section, of the cell of FIG. 2, illustrating the pivotal motion of the reflectors and changing direction of the microwaves reflected as a result of the motion;

FIG. 4B is a view similar to FIG. 4A illustrating the reflectors fully pivoted into a horizontal coplanar configuration;

FIG. 5A is a perspective view of a modified embodiment of a cell for incorporation into a food container, illustrating a bimetallic coil carrying microwave reflective element;

FIG. 5B is a plan view of the cell of FIG. 5A illustrating the rotated position of the reflective elements with unwinding of the heated coil;

FIG. 6 is a perspective view, partially in section, of a bowl, illustrating a plurality of cells of FIG. 5A incorporated into the wall of the bowl;

FIG. 7A is a modified embodiment of a reflective cell for incorporation into a food container, illustrating the cool condition of a bimetallic element having four arms in cone-like configuration;

FIG. 7B is a perspective view of the heated condition of the bimetallic element of FIG. 7A in which the arms are spread outwardly into a generally planar configuration to reflect the bulk of the microwaves directed at the element.

FIGS. 8–18B are directed to the simplified device of parent application Ser. No. 019,216 with FIG. 8 illustrating a perspective view of the device mounted on the floor of the cavity of the radiant energy heating oven;

FIG. 9 is a perspective view of the simplified device of FIG. 8;

FIG. 10 is a side sectional view of the device of FIG. 9 taken along the line 10—10 therein;

FIG. 11 is a partial top plan view of a base illustrating several collectors each having a plurality of tabs cut from the base and angled upwardly from the base;

FIG. 12 is a partial top plan view of the base of FIG. 11 as seen before tabs are angled upwardly from the base;

FIG. 13 is a perspective view illustrating the simplified device mounted on the walls of the cavity of the radiant energy heating oven;

FIG. 14 is a top plan view illustrating the encasing structure of FIG. 10 as a segmented tray having a plurality of sections;

FIG. 15 is a schematic illustrating the device in conjunction with a commercial conveyor belt system;

FIG. 16 is a partial side sectional view of a single collector illustrating the bimetallic tabs;

FIG. 17 is a partial side sectional view illustrating the opposed collectors of an alternative embodiment;

FIG. 18B is a top plan view of the base shown in FIG. 18A illustrated with the tabs angled upwardly from the base;

FIGS. 19–24B are directed to the present invention and FIG. 19 is a partial side sectional view of a single cell of the collector of the present invention illustrating the use of a thickness gradient for the material utilized to construct the tabs;

FIG. 20A is a partial side sectional view of a single cell of the collector illustrating a single tab in a horizontal or closed position;

FIG. 20B is a partial side sectional view of a single cell of the collector illustrating a twisted tab;

FIG. 20C is a partial side sectional view of a single cell of the collector illustrating bimetallic tabs;

FIG. 20D is a partial perspective view illustrating both open and closed collectors;

FIG. 21 is a front view of a microwave oven illustrating a dome-shaped cover positioned over an apparatus and food product therein and illustrating a variation in the oven floor shape and design;

FIG. 22 is a side sectional view of a container illustrating a plurality of metal tab portions incorporated therein;

FIG. 23 is a top plan view of a ceramic substrate collector having a spacing border;

FIG. 24A is a side plan view of a rounded collector cell tab; and

FIG. 24B is a side plan view of a polygon shaped collector cell tab.

DESCRIPTION OF THE PREFERRED EMBODIMENTS

Figure 8:
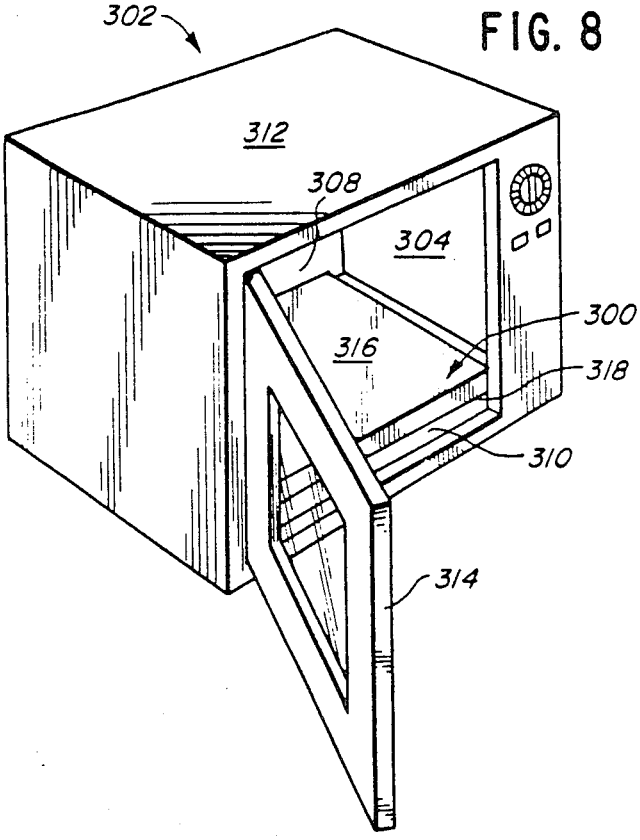

FIGS. 1–7B are illustrative of embodiments disclosed in parent application Ser. No. 765,374.

Referring to FIG. 1, a plurality of reflective cells in a first embodiment are generally designated by reference character 10 and installed within a conventional microwave oven generally designated by reference character A. The cells 10 can be arranged in rectilinear rows in which the cells are spaced at least 1/16 inch in order to prevent arcing between the cells 10. Preferably, the rows of cells 10 cover substantially the entire bottom wall B of the oven A and the cells are elevated at a distance, for example, $\frac{3}{4}$ to 1 inch above the wall B. In this embodiment, the food to be cooked is placed above the cells 10 as more fully described hereinafter.

Referring to FIGS. 2 and 4A, each cell 10 includes three reflectors 12, 14 and 16 formed by strips of aluminum or similar material which reflects microwaves. The reflectors 12, 14 and 16 are bonded to a flexible rubber sheet 18. The reflectors 12, 14 and 16 are spaced approximately 1/16 to $\frac{1}{8}$ inch in side-by-side parallel arrangement. The middle reflector 14 is attached to a lower surface of a fixed plate 20 of plastic or similar material which is transparent to microwaves. This central reflector 14 is held horizontally stationary by the plate 20 which preferably extends to support the central reflector in all of the cells 10. The sheet 18 provides flexible hinging between the reflector 14 and each of the other reflectors 12 and 16, which allows the reflectors 12 and 16 to pivot in relation to the fixed central reflector 14. The reflectors 12 and 16 pivot about respective portions 18A and 18B of the sheet 18 narrowly separating the reflectors 12 and 16 from the fixed reflector 14. As shown in FIG. 2, when the oven A is not in operation, the reflectors 12 and 16 are pulled by gravity to extend in generally vertical parallel planes below the plane of the horizontally oriented reflector 14. In this configuration, the reflectors 12 and 16 face one another in spaced opposition. Between the vertically oriented reflectors 12 and 16, a U-shaped bimetallic element 22 is disposed so that the arms 22*a* and 22*b* of the U-shaped element 22 extend horizontally in generally spaced, parallel opposition between the reflectors 12 and 16, when the oven A is not in operation and the element 22 is in generally "cold" condition. Any conventional bimetallic element, for example, copper-aluminum, can be employed in suitably fabricated, U-shaped configuration. The arms 22*a* and 22*b* can be dimensioned, for example, approximately ¾ inch in length and extend horizontally parallel and below the horizontal plane of the reflector 14. Between the arms 22*a* and 22*b*, a bar 24 of ferrite or similar material which readily absorbs microwaves is positioned to heat the element 22.

Referring to FIG. 3, the bight portion 22*c* of the element 22 is attached to the sheet 18 below the stationary reflector 14 so that the bight 22*c* is fixed while allowing the arms 22*a* and 22*b* to freely move horizontally between the positions illustrated in FIGS. 2 and 4B. The bar 24 is stationary and can be attached to the bottom surface of sheet 18 below the central reflector 14. As shown in FIG. 2, the cells 10 have a floor 26 of plastic or similar material which is transparent to microwaves and both the bight 22*c* and the bar 24 can be alternatively fixed to the upper surface of the floor 26. Plastic columns 28 separate the plate 20 from the floor 26. The central reflector 14 shields the bar 24 from microwaves directly transmitted from the generator so that the bar 24 does not overheat.

Referring to FIG. 4A, a relatively large portion of food C is placed within the oven A above the plate 20 and will extend over a plurality of the cells 10, which are in the range 1–2 inches long. When the oven A is operated, the conventional microwave generator (not shown) directs microwaves represented by arrows D downward through the food C which absorbs some of the microwaves while other microwaves pass through the food C and are reflected upward by impingement against the central reflector 14 or the bottom wall B of the oven.

Additionally, the microwave generator directs some of the microwaves angularly against the sidewalls of the oven A which reflects these microwaves (not shown for simplicity) angularly downward through the food. Thus, microwaves are reflected from the bottom wall B in both normal and angular directions. As a result of numerous angularly reflected microwaves, the bar 24 will absorb microwaves and begin to generate heat. The heat generated by the bar 24 is conducted to the bimetallic element 22. As the element 22 heats, the arms 22*a* and 22*b* move apart or spread horizontally and force the respectively engaged reflectors 12 and 16 to pivot upwardly into the sequential phantom positions shown in FIG. 4A. As a result of the pivotal motion of the reflectors 12 and 16, some of the microwaves D which pass through the food C and the plate 20 will impinge on and reflect from the reflectors 12 and 16 at progressively different and decreasing angles as shown by the reflected microwaves D'. The reflected microwaves D' pass through the food C at angles which change with the pivotal movement of the reflectors 12 and 16 and thus, traverse different paths through the food C as the pivotal motion progresses.

Referring to FIG. 4B, once the arms 22*a* and 22*b* have fully spread and forced the reflectors 12 and 16 into the horizontal coplanar position, the reflectors 12 and 16 will engage the lower surface of the plate 20 which is generally cooled by food which has only begun to heat. The reflectors 12 and 16 are thus cooled by the plate 20 resulting in cooling of the arms 22*a* and 22*b* which remain in respective engagement with the cooled reflectors 12 and 16. As the arms 22*a* and 22*b* cool, they retract inwardly toward one another allowing the respective reflectors 12 and 16 to pivot downwardly in the reverse paths of motion illustrated in FIG. 4A. Thus, after temporarily reaching the coplanar positions shown in FIG. 4B in which the reflected microwaves D' are directed upward and generally coincident with the impinging microwave D, the downwardly pivoting reflectors 12 and 16 will again reflect microwaves at progressively increasing angles in reverse of the progression shown in FIG. 4A. However, since the bar 24 continues to heat, the arms 22*a* and 22*b* become increasingly heated as they retract and will once again spread forcing the repeated upward pivot of the reflectors 12 and 16. As a result of the cycled, upward and downward pivotal motion of the reflectors 12 and 16, the microwaves reflected therefrom will also be directed at cycled, increasing and decreasing angles so that the food C is subjected to a changing gradient in concentration of microwaves D'. This changing gradient prevents absorption of microwaves at fixed concentrations in the various strata within the food, and thus eliminates creation of "hot spots". The effect of the cycled change in the direction of reflected microwaves D' in FIG. 4A will be multiplied by the microwaves initially directed by the generator against the sidewalls of the oven which are reflected therefrom to impinge the reflectors 12 and 16 and thus, are subjected to the similar change in reflected angles.

Each cell 10 operates independently of the other cells. The combined effect of the action of the cells is an upward shifting in the focus of microwave concentration (referred to as the power curve) in the design of the oven, as well as a multiplicity of motions redirecting reflected microwaves, both of which are particularly beneficial in microwave cooking of large or thick portions of food.

In modified embodiments, the cells can be incorporated into containers for cooking food, for example, a bowl. Referring to FIG. 6, a bowl generally designated by reference character 100 has a wall 102 within which are embedded a plurality of cells generally designated by a reference character 110. The wall 102 is plastic or similar material transparent to microwaves. Referring to FIG. 5A, the cell 110 includes a stationary generally circular configuration of diametrically intersecting rods 112 of aluminum or similar material which reflects microwaves. As best shown in FIG. 5B, the rods 112 form a pattern of eight radial projections, however the number of projections may be variable and is dependent upon maintaining a distance between the peripheral ends 112*a* less than approximately ½ inch, and therefore, fewer or greater than eight radial projections may be required depending upon the length of the rods 112 and the size of the cell 110. Each cell 110 further includes a generally circular, bimetallic coil 114 which circumscribes and is connected to a wheel 115 on which the ends of eight (8) diametrical spokes 116 are attached. The spokes 116 intersect coaxially with the intersection of the rods 112, and the coil 114 is dimensioned so that in its "cold" condition the spokes 116 are superimposed on rods 112 in congruent manner. The spokes 116 are also made of aluminum or similar material which reflects microwaves.

Referring to FIGS. 5B and 6, when the bowl 110 containing food product (not shown) is placed in a microwave oven and cooking is begun, the food heats and conducts heat to the coil 114. As best shown in FIG. 5B, the heated coil 114 expands in an unwinding motion so that spokes 116 are rotated from the superimposed position of FIG. 5A to the position of FIG. 5B in which the spokes 116 generally bisect the angles between the radial projections of the rods 112. In this position, the adjacent ends 112*a* and 116*a* of the respective rods 112 and spokes 116 will be at a distance of approximately ¼ inch. The microwaves typically have a wavelength less than ¼ inch and the configuration of alternating rods 112 and spokes 116 effectively reflects the bulk of the microwaves directed at the cell 110. Particularly when the food is very cold or frozen, the peripheral area of the food ca become heated and thus heat the coil of a particular cell 110, even though the interior of the food may temporarily remain cool or frozen. As a result, the peripheral area which heats the coil 114 can cool again by contact with flowing liquid produced in the heating process or by simple heat transfer to the remaining cool or frozen areas. Thus, the peripheral area of the food can again cool the coil 114 and reverse the rotation of the spokes 116 to approach their original position as shown in FIG. 5A, which again allows the microwaves to pass through the cell 110. The unwinding and winding of the coil 114 is thus dependent upon the heating and cooling of the peripheral area of the food in which a particular cell 110 is in contact. The combined effect of the coil motion in the plurality of cells 110 produces changing concentration of the microwave reflection passing through various strata within the food to promote uniform heating.

Referring to FIG. 7A, a reflective cell 210 is a modified embodiment of a cell for incorporation into the wall of a bowl or similar food heating container. The cell 210 includes a bimetallic element 212 which has four arms 212*a* which are bent from their central intersection to form a cone-like cruciform. The bimetallic element 212 can be stamped and bent into the cone-like configuration of FIG. 7A, and then incorporated into the wall of a container similar to the bowl in FIG. 6. Referring to FIG. 7B, when the microwave oven is operated and cooking is begun, the heated periphery of the food (not shown) heats the element 212 causing the arms 212*a* to spread outwardly into a generally planar configuration in which the arms 212*a* intercept and reflect the bulk of the microwaves directed at the cell 210. When the periphery of food products cools, the arms 212*a* will again fold inward to the cone-like configuration of FIG. 7A, followed by reheating into the configuration of FIG. 7B. In this embodiment, the element 212 serves as both the bimetallic element and the reflector.

The combined motions of the cells 210 promote uniform heating of the food by changing the concentration of microwave reflection passing through various strata within the food.

FIGS. 8–18B are illustrative of embodiments disclosed in parent application Ser. No. 019,216.

Referring to FIG. 8 one embodiment of the simplified device or apparatus is designated generally by the reference numeral 300 and is shown installed within a conventional microwave oven, designated generally by the reference numeral 302. The oven 302 has walls, for example, 304 and 308 and a floor 310. A housing 312 has an access door 314 through which to gain access to the interior of the oven 302.

As an example of the unique ability of the device 300 to uniformly heat a food product, a cake was prepared in an conventional microwave oven such as the oven 302 wherein the apparatus 300 was placed on the floor 310 of the oven 302. The cake batter was prepared from a prepackaged cake mix according to the directions on the package. A sheet of wax paper was placed on the bottom of a 12 inch square plastic cake pan before the cake batter was put in the cake pan. A sheet of plastic wrap was placed over the pan and slits were cut in the plastic wrap to allow steam to escape from the covered cake pan. After approximately 8.5 minutes on a high setting the cake had uniformly risen and uniformly cooked. Even though the cake was inadvertently tilted as it was removed from the oven, it cooled to form a cake with excellent uniformity and texture.

In another example, a 4.3 pound whole chicken was wrapped in a sheet of plastic wrap and centered on a tray formed by the device 300. The device 300 was placed on the floor 310 of the oven 302 and the chicken was heated for twenty-seven minutes at a high setting (750 watts). The chicken was uniformly cooked at that time without moving or turning of the chicken. The wrap was removed at about thirteen minutes to allow the chicken to brown. Further, the wing of the chicken, generally requiring protection from over cooking, emerged as tender and juicy as the remainder of the chicken.

The most striking example is the ability of the device 300 to promote the uniform cooking of eggs in the presence of a radiant energy heating source. In a normal microwave oven such as the oven 302, eggs will cook unevenly resulting in an unappealing inconsistency in taste, texture, and appearance. Under the influence of the energy field radiated by the device 300, however, the eggs are uniformly cooked with a remarkable balance of doneness between eggs when several eggs are prepared at the same time.

Figure 9:
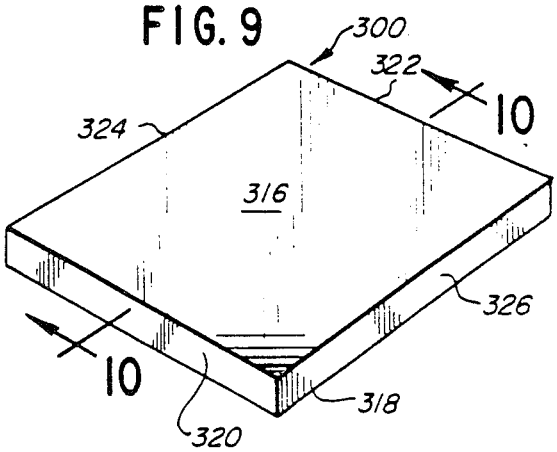

Referring to FIG. 9 the device 300 is illustrated in a perspective view wherein an upper surface 316, a lower surface 318, and walls 320, 322, 324, and 326 are more clearly seen. The device 300 is not restricted to a particular shape or dimension so long as it conforms to the limitations discussed below. However, the device 300 can be sized such that it can be placed on the floor 310 of the oven 302 when needed and conveniently removed from the oven 302 through the door 314 when not needed. Additionally, when the device 300 is configured with a relatively flat upper surface 316 and a relatively flat lower surface 318, the device 300 will sit on the floor S10 of the oven 302 such that a food container (not shown) can be placed directly on the upper surface 316.

Some glass cooking trays and containers are formed including a metallic material. It has been found that these trays and containers can interfere with the efficiency of the device 300. Generally, any plastic container designed for microwave utilization can be used in conjunction with the device 300.

Where a smaller microwave oven is used, the food product or container must not be so large that it touches the walls of the oven 302, because that will interfere with the device efficiency and can cause uneven cooking. It has been found that a distance of approximately 1½ inches from the walls or from the door 314 is sufficient to prevent interference with the efficiency of the device 300.

One embodiment will be discussed in greater detail with reference to FIGS. 10 and 11. A base 328 having an upper surface 330 (best seen in FIG. 10) has a plurality of collectors 334 formed therein. Each of the collectors 334 has a periphery 336 located on the base 328 and a radiant energy transparent region 338 within the periphery 336. The collectors 334 further include a plurality of tabs 340 located along the periphery 336 and extending upwardly from the base 328 over the region 338.

Figure 10:
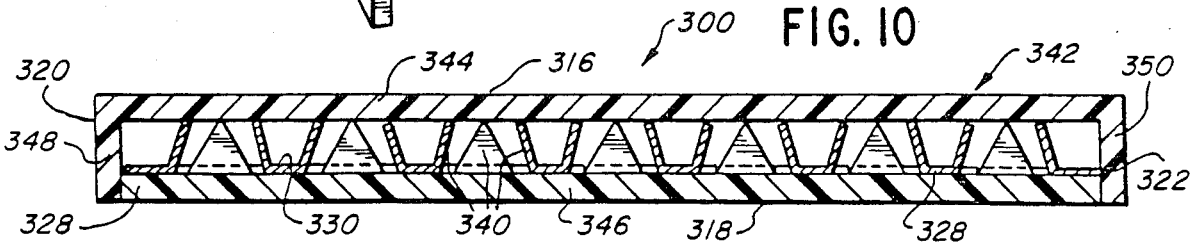
Figure 11:
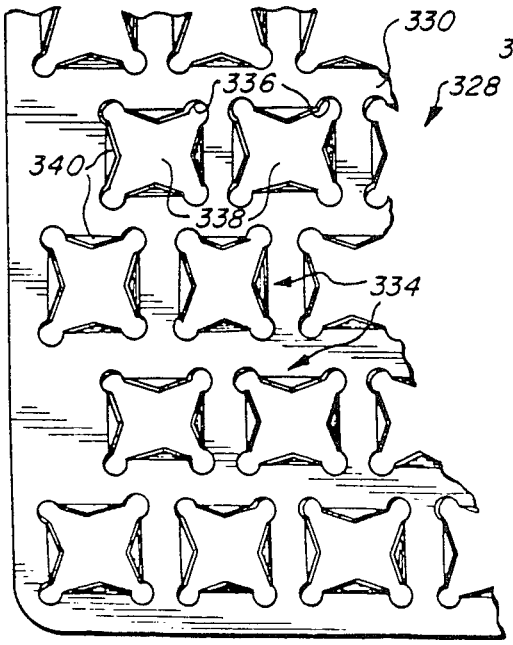

As seen in FIG. 10, the tabs 340 extend upwardly from the base 328 at an angle of 80–90 degrees relative to the region 338. It is believed that the collectors 334 collect the radiant energy incident on the collectors 334 and redistribute that energy in a distinct energy field to resistively couple with the food product being heated. As the food product heats the energy field will shift to the unheated portion of the food product, thus promoting uniform heating.

The angle of the tabs 340 determine the strength of the field distributed by the collectors 334. It has been found that when the angle of the tabs 340 relative to the region 338 is less than 80 degrees the strength of the field distributed by the collectors 334 is diminished. As the angle is further decreased the strength of the field correspondingly decreases. Therefore, although the device 300 will function at other angles, a range of 80–90 degrees has been found to most efficiently promote the uniform heating of a food product.

Figure 16:
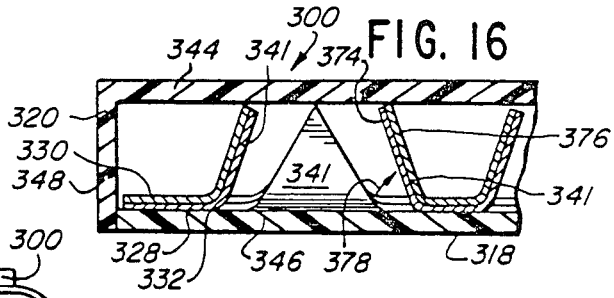

The collectors 334 are formed from a radiant energy reflective material. As will be explained, the material can be a bimetallic material wherein the angle of tabs 341 (as seen in FIG. 16) relative to the base 328 will fluctuate as the bimetallic tabs 341 first heat and then cool thus causing the field of energy distributed by the collectors 334 to correspondingly fluctuate.

Alternatively, the material can be aluminum or a similar material which will reflect the radiant energy incident on the collectors 334. Where the radiant energy reflective material is aluminum, it has been found that a thickness of 0.007 to 0.008 inches provides sufficient stability to form the tabs 340 while keeping the overall weight of the device 300 at a minimum.

An encasing structure 342 (FIG. 10) has an upper wall 344, a lower wall 346, and sidewalls 348 and 350. The encasing structure 342 is utilized to protect the collectors 334 and to prevent them from being damaged either by handling or by the food product. So as not to interfere with the efficiency of the collectors, the encasing structure 342 is formed from a radiant energy transparent material such as a high temperature thermoplastic. The encasing structure 342 is not restricted to a specific size or shape so long as it functions to encase and to protect the collectors 334 and the base 328. In fact, as will be discussed in connection with FIG. 14, the encasing structure 342 can have a tray configuration. However, it has been found that the upper surface 316 of the encasing structure 342 should be positioned such that the food product is held at least approximately $\frac{3}{8}$ to $\frac{3}{4}$ inch away from the collectors 334 to prevent interference with the field distributed by the collectors 334.

Referring again to FIG. 11, the collectors 334 have four triangularly shaped tabs 340 located along the periphery 336. In this instance, the periphery 336 has the general shape of a square. It is also contemplated that the periphery 336 of the collectors 334 can form a circle or a hexagon. In fact, tests have shown that the most efficient shape for utilization with a small volume food product is a grouping of collectors SS4 having the periphery 336 in alternating square and circular shapes.

Figure 12:
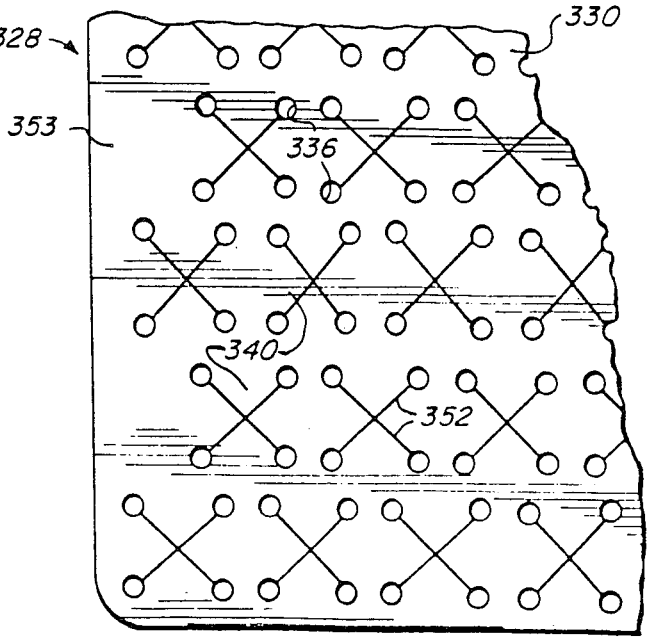
Figure 18A:
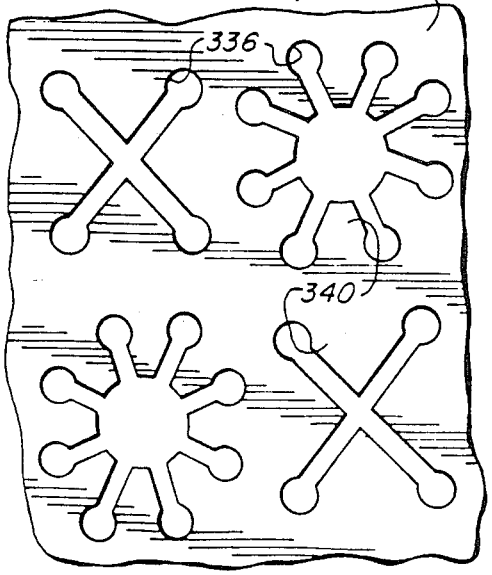
FIG. 18A is a top plan view of the base illustrating the collectors having an alternating square and circular shape with the tabs cut from the base.
Figure 18B:
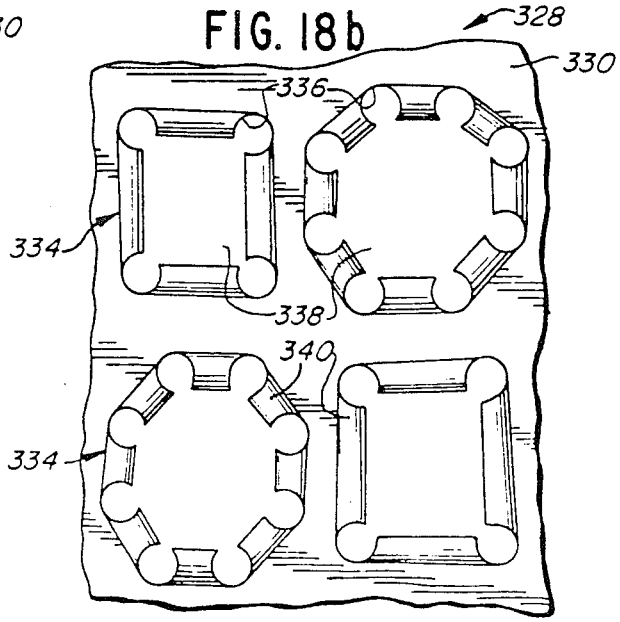

The number and shape of the tabs 340 can vary with the size of the collectors 334 and the shape of the periphery 336. For example, as seen in FIGS. 11 and 12, the collectors 334 can have a periphery 336 in the shape of a square and have four tabs 340 each of which is in the shape of a triangle or, as seen in FIGS. 18A and 18B, the collectors can have multiple tabs 340 each of which is essentially in the shape of a truncated triangle. The tabs 340, however, must be spaced apart one from another, a distance sufficient to prevent arcing in the presence of the radiant energy.

The collectors 334 can be coated with an insulating material such as silicone to further prevent arcing in the presence of the radiant energy. Other insulating materials can be substituted so long as they do not interfere with the field distributed by the collectors 334. The coating can be applied to the collectors 334 as well as to the base 328, but must at least coat the tabs 340 to effectively prevent arcing in the presence of radiant energy.

The size of the collectors 334 are related to the wave length of interest. For example, the collectors 334 with the periphery 336 having an approximate diameter of one inch can be used for a small volume food product. A larger diameter of approximately two and $\frac{3}{8}$ inches is appropriate for a larger volume food product where a larger reflective field is necessary. Also, the collectors 334 having the periphery 336 of different diameters can be incorporated into the single device 300.

The following tests demonstrate the effect of the size of the collectors 334 on a small volume food product. The tests were performed utilizing a 12 inch by 12 inch plastic tray-shaped device 300 and a conventional consumer microwave oven set at high (750 watts). Eggs were chosen as a small volume test food. A subjective quality rating, based on a scale of one to ten, was chosen to indicate the texture, taste, and appearance of the eggs prepared using the device 300 as compared to eggs prepared using a conventional non-microwave cooking range. The approximate dimensions of the periphery 336 of the collectors 334 were as follows:

| | | |
|---|---|---|
| | round | one and $\frac{1}{2}$ inches in diameter |
| | square | one inch on a side |
| | large round | two and $\frac{3}{8}$ inches in diameter |

| | | | |
|---|---|---|---|
| I. | 45 Round Collectors Over- 50 Round Collectors | A. | One egg - 35 seconds<br>Cooked Medium-light (very even)<br>Quality 9 |
| | | B. | Two eggs - 55 seconds<br>Cooked Medium - Medium light<br>Quality 7 (balance of doneness comparatively was very good) |
| II. | 45 Round Collectors Over- Round - 28 Square - 27 | A. | One egg - 35 seconds<br>Cooked Medium-light<br>Quality 7 |
| | | B. | Two eggs - 55 seconds<br>Cooked Medium - Medium light<br>Quality 5 |
| III. | 45 Round Collectors Over- 60 Square Collectors | A. | One egg - 35 seconds<br>Cooked incomplete<br>Quality N/A |
| | | B. | One egg - 40 seconds<br>Cooked Medium-light<br>Quality 8 |
| | | C. | Two eggs - 55 seconds<br>Cooked incomplete<br>Quality N/A |

-continued

| | | | |
|---|---|---|---|
| IV. | None<br>Over-<br>Round - 28<br>Square - 27 | A. | One egg - 35 seconds<br><br>Cooked Medium light<br>Quality 9 |
| | | B. | Two eggs - 55 seconds<br>Cooked Medium - Medium light<br>Quality 7 |
| V. | None<br>Over-<br>60 Square Collectors | A. | One egg - 35 seconds<br><br>Cooked Medium-light<br>Quality 8 |
| | | B. | Two eggs - 55 seconds<br>Cooked Medium - Medium-light<br>Quality 5 (Cooked well individually no balance between eggs) |
| VI. | 13 Large Round Collectors<br>Over-<br>None | A. | One egg - 35 seconds<br><br>Cooked Medium-light<br>Quality 9 (very good) |
| | | B. | Two eggs - 55 seconds<br>Cooked Medium - Medium-light<br>Quality 7 (explosion - need more large collectors) |
| VII. | 13 Large Round Collectors<br>Over-<br>None | A. | One egg - egg no good<br><br>Cooked uneven<br>Quality none |
| | | B. | Two eggs - Same as A (insufficient collectors to carry and maintain field load) |

The above data indicates that the smaller collectors 334 will produce a good quality rating for a small volume food product such as eggs. However, where the large collectors were utilized, they were unable to create and maintain a radiant energy field to resistively couple with the eggs.

The base 328 can be a radiant energy reflective material, such as aluminum, from which the tabs 340 have been cut, formed, and angled out of the base plane. In this case, the amount of radiant energy reflected by the base 328 is directly related to the amount of material within the periphery 3S6 that has been removed in the process of forming the tabs 340 and to the number of collectors 334 formed on the base 328. Therefore, the collectors 334 should be spaced one from another such that the ratio of the exposed material of the base 328 compared to the area within the periphery 336 is sufficiently reduced to avoid excess interference from the radiant energy reflected by the upper surface 330 of the base 328 while not effecting the structural integrity of the base 328. For example, tests have shown that a 0.007 to 0.008 inch aluminum base 328 having the collectors 334 with the one inch diameter periphery 336 alternating in shape between square and circular should be spaced apart at a distance of ⅛ to 1/16 inch to reduce interference from the radiant energy reflected by the upper surface 330 of the base 328.

The simplified device 300 can be conveniently and inexpensively manufactured from a single sheet of radiant energy reflective material 353. Referring to FIG. 12, the outer periphery 336 is located on the sheet 353 and the collectors 334 are scored and cut. The tabs 340 are cut such that tabs 340 remain affixed to the outer periphery 336 of the base 328. The tabs 340 can be either cut or stamped from the base 328 but the edges 352 of the tabs 340 must be relatively cleanly cut so as not to interfere with the radiant energy field of the collectors 334. In the example illustrated in FIG. 12, the tabs 340 are in the shape of a triangle and, for this example, will require no further forming. The tabs 340 are bent out of plane from the base 328 to form the region 338 therebeneath. The tabs 340 are positioned at an angle of less than 90 degrees relative to the region 338 to form the collectors 334. Referring to the circular shape collectors 334 (seen in FIGS. 18A and 18B), the tabs 340 can be cut to the desired shape either with the original stamping or shaped subsequent to stamping. The collectors 334 can also alternate on a single sheet. For example, as seen in FIGS. 18A and 18B, the collectors 334 can alternate between those having a circular or a square periphery 336. Additionally, the collectors 334 can be supplied with a protective coating of an insulting material such a silicone. Finally, the base 328 and the collectors 334 are enclosed in an appropriate radiant energy transparent encasing structure.

Figure 13:
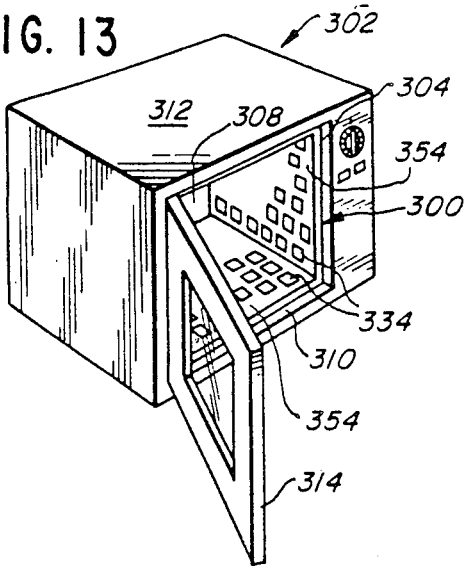

Referring to FIG. 13, the device 300 can be provided with a modified encasing structure 354 such that the device 300 can be mounted on or in one or more of the walls 304, 308 or the floor 310 of the microwave oven 302. In this case, it has been found that the collectors 334 having a larger diameter are best suited to be mounted on or in the walls because they provide a larger reflective field needed to uniformly heat a food product when it is located at a distance from the device 300. When the device 300 is mounted on or in the floor 310 of the microwave oven 302, both small and large diameter collectors 334 can be incorporated into a single device 300 to uniformly heat both small and large portions of the food product placed on the device 300.

Figure 14:
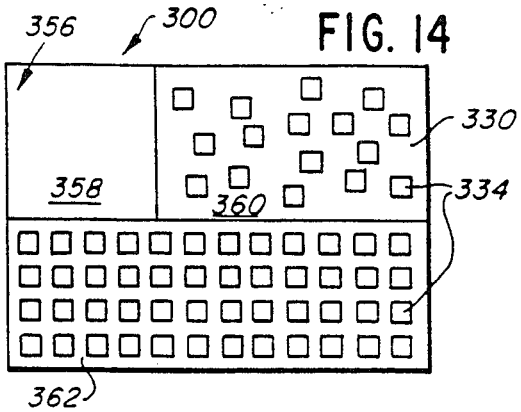

In FIG. 14, the device 300 is shown having a tray shaped encasing structure 356. For illustrative purposes, the collectors 334 are visible through the tray shaped encasing structure 356 The structure S56 is further sectioned into compartments 358, 360 and 362. The collectors 334 are arranged on the base 330 such that each of the sectioned compartments 358, 360, and 362 vary in their ability to promote the heating of the food product. For example, the compartment 358 is shown having no collectors 334 and will, therefore, not promote the heating of the food product placed on that compartment. The compartment 360 is shown having the collectors 334 spaced relatively far apart such that the heating of the food product placed on that compartment is slightly promoted. The compartment 362 is shown having the collectors 334 tightly grouped such that the heating of the food product placed on that compartment is greatly promoted. The relative ability of each of the compartments 358, 360, and 362 could also be varied by varying the shape or size of the collectors 334 beneath that compartment such as by providing the smaller diameter collectors 334 for a smaller food product and by providing the larger diameter collectors 334 for a larger food product.

The compartments 358, 360, and 362 can be provided with identifiers, such as color, for readily identifying the relative ability of each of the compartments 358, 360, and 362 to promote the heating of the food product. In the example illustrated by FIG. 14, the compartment 358 could be identified by a cool color such as white or light blue, the compartment 360 could be identified by a warm color such as pink, and the compartment 362 could be identified by a hot color, such as red.

Figure 15:
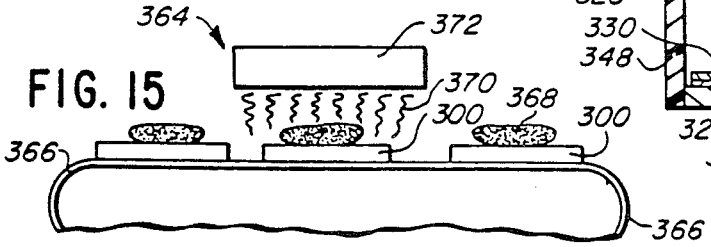

The device 300 is not restricted to use with the conventional microwave oven 302, illustrated in FIGS. 8 and 13. In FIG. 15, the device 300 is illustrated in conjunction with one example of a commercial conveyor belt system generally designated 364 having a conveyor belt 366. The device 300 with a food product 368 thereon is placed on the conveyor belt 366. As the conveyor belt 366 carries the device 300 through a radiant energy field 370 produced by a radiant energy source 372 the plurality of collectors 334 collect the radiant energy from the radiant energy field 370 that is incident on the collectors 334 and redistribute that energy in a distinct energy field to promote the heating of the food product 368. It can be seen that the device 300 having the tray shaped encasing structure 356, illustrated in FIG. 14, is particularly advantageous for use with the commercial conveyor belt system 364 illustrated in FIG. 15. An entire meal having several of the food portions 368 each requiring a separate degree of heating can be prepared with one exposure to the radiant energy field 370.

FIG. 16 illustrates one example of bimetallic tabs S41 having two bimetallic layers 374 and 376. In general, when a solid is heated, it expands. However, all substances do not expand alike. Some metals, like aluminum, expand up to twice as much as others. In the bimetallic tabs 341, two layers of different metals, are bonded together. When heated, one metal expands more than the other, causing the tabs 341 to bend. The hotter the tabs 341 become the more it will bend. When the tabs 341 cool down to the original temperature, the tabs 341 become straight again. This differential expansion is applied to the tabs 341 of the collectors 334 to effect a fluctuation of the angle between the tabs 341 and the region 338, indicated by an arrow 378. If the layer 376 is aluminum, the angle indicated by the arrow 376 will decrease as the tabs 341 are heated and then return to the original position as the tabs 341 cool. Further, the metal chosen for the layer 374 can differ according the relative thickness of the layers 374 and 376 to maintain the angle of the tabs 341 in the approximate range of 80°–90°.

Figure 17:
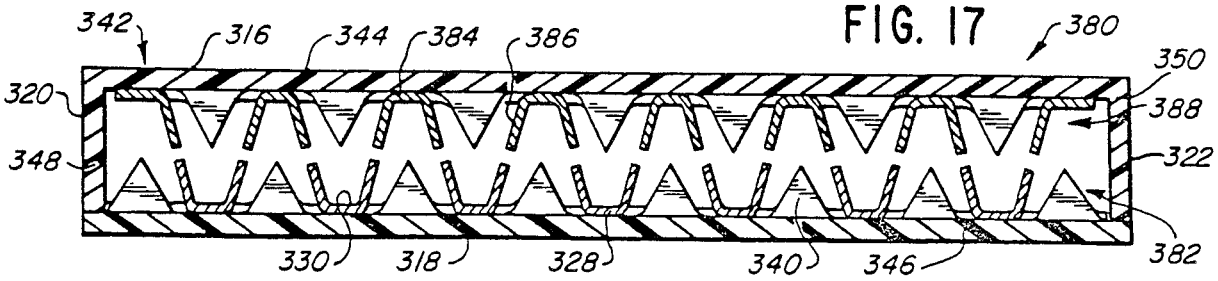

Referring to FIG. 17, a second embodiment of the simplified device or apparatus is designated generally by the reference numeral 380. In the device 380, the base 328 having the plurality of radiant energy reflective tabs 340 thereon forms a first plurality of collectors 382. A second base or plate 384 having a second plurality of radiant energy reflective tabs 386 thereon forms a second plurality of collectors 388. The plate base 384 is seen to have tabs 386 extending downwardly therefrom such that the second plurality of collectors 388 is positioned opposed to the first plurality of collectors 382 within the encasing structure 342. Tests have shown that the first plurality of collectors 382 and the second plurality of collectors 388 cooperate most efficiently when they are positioned offset one from another as illustrated in FIG. 17.

Tests have further shown that the device 380 is most efficient where the second plurality of collectors 388 are configured substantially in the shape of a square and the first plurality of collectors 382 are configured to alternate between substantially that of a square and substantially that of a circle.

The parameters and limitations discussed in reference to the device 300 of the first embodiment are equally applicable to the device 380 of the second embodiment. With reference to the device 380, it is believed that the collectors 382 and 388 cooperate to more efficiently collect the radiant energy incident on the collectors 382 and 388 and to more efficiently redistribute that energy in a distinct energy field. This distinct energy field then will resistively couple with the food product to promote the uniform heating of the food product within the reflected field.

The method and apparatus of the present invention now will be discussed with reference to FIGS. 19–24B.

The weight or gauge of the material utilized for the construction of the collector cells has been found to vary the operation of the radiant energy collector or apparatus of the present invention. For example, a thicker gauge will cause the cells to form a stronger radiant energy field, but has a slower response and field equalization rate. A thinner gauge will result in an enhanced response rate which will equalize the fields quicker. Therefore, the performance of the radiant energy collector is enhanced when a relatively thin gauge collector material is utilized, such as an aluminum foil 0.001 to 0.003 inches. However, a thin gauge is very fragile and can be difficult to manage during the production process. One way to strengthen the material is to coat the foil with an energy transparent material to make it more durable. It has been discovered that arcing of the cell tabs is not a significant problem and the additional material is merely utilized to strengthen the tabs.

On the other hand, when a thicker gauge is utilized, for example 0.009 to 0.010 inches, the radiant energy collector is easier to manufacture, but the field of radiant energy formed by the cells can be too powerful for use with a microwave oven. One method to overcome this problem is to adjust the cell tabs to be compatible with a particular type of microwave oven. This adjustment will be discussed in detail below. Another method to overcome this problem is to utilize a thickness gradient for the cell tab material. A thickness gradient will provide a cell tab that will produce an energy field that can be utilized in a microwave oven and will also provide a construction material having the strength necessary to manufacture the radiant energy collector.

The use of a construction material having a thickness gradient is illustrated in FIG. 19. This embodiment of the radiant energy collector or improved apparatus of the present invention is designated generally by the reference numeral 400. A plurality of tabs 402 extend downwardly from a plate 404. In contrast to the orientation of the device 300 in FIG. 10, the apparatus 400 is inverted therefrom. Unexpectedly, it has been found that the radiant energy collector operates more efficiently in a microwave oven in an orientation where the tabs 402 extend downwardly rather than where the tabs 340 extend upwardly from the base 328 as illustrated in the device 300 in FIG. 10. The tabs 402 are formed from a radiant energy reflective material and are shaped such that the gauge of the tab material decreases in a gradient from a base end 406, which is affixed to the plate 404, to a free end 408. In other words, the base end 406 of the tab 402 is thicker than the free end 408. A cell 410 is formed by a radiant transparent region or opening 412 in the plate 402 formed between the tabs 402. The opening 412 generally is provided by the formation of the tabs formed or cut from the base plate 404. This construction will result in the necessary strength to manufacture the radiant energy collector but will also result in a cell that can be adjusted so that it produces an energy field compatible with a particular type of microwave oven.

Referring to FIG. 20A, another embodiment of a radiant energy collector or improved apparatus of the present invention is designated generally by the reference numeral 414. The radiant energy collector 414 again is substantially similar to the device 300 illustrated in FIG. 10, but inverted thereto. Again, a plurality of tabs 416 extend downward from a base or a plate 418. In this embodiment, the tabs 412 are formed of a uniform thickness dimension. A cell 420 is formed by a radiant energy transparent region or opening 422 in the plate 418.

Further, it has been found that the angle or position of one or more of the tabs 416' can be utilized to affect the performance of the radiant energy collector 414. When a single tab 416' of the cell is physically or manually positioned coplanar with the plate 418, i.e. in a closed position relative to the radiant energy transparent region 422, it effectively shields the portion of the food product (not shown) that is adjacent to (over) the particular closed tab 416'. It is believed that this action temporarily increases the field of energy within that cell 420. However, when a single tab is closed, the total food product will heat at substantially the same rate since other tabs 416 on the cell 420 are still open. This does not reduce the total available cooking power to the food product located over the cell 420. As additional tabs in the cell 420 are closed, the energy field in the cell 420 will become increasingly weaker until the cell reaches the point where all of the tabs 416 are in the closed position, hence the cell itself is closed (best seen in FIG. 20D).

Closing a particular cell causes it to become a power drain and a directional draw of radiant energy to that part of the oven and a drain from the microwave oven's total available heating power. Even though additional radiant energy is drawn to the area, the food product adjusts to the total oven exposure as heat increases. The radiant energy field reforms in those areas that have less resistance or where there are lower temperature areas in either the food product or in other cells of the radiant energy collector. Further, as additional cells in the radiant energy collector are closed, the radiant energy field becomes increasingly balanced. When all or most of the cells are closed, depending on the design or watts of an individual microwave oven, the food product will cease to heat. In the embodiments of FIGS. 19, 20A and 20B, the tabs are physically moved to adjust the operation of one or more cells. In the embodiment of FIG. 20C, the tabs of the collectors are designed to automatically move to adjust to the applied microwave power, which design also can be applied to all of the embodiments or selected cells therein.

By adjusting the angular position of the tabs, the available radiant energy within an individual microwave oven can be controlled. In effect, selective manipulation of the tabs can be utilized as a control mechanism to balance or direct the microwave energy to desired areas of the food product. The food product located adjacent a closed cell is shielded and will heat at a reduced rate compared to food product that is located over open cells or to food product that is not located over collector cells.

In FIG. 20A, the collector 414 is seen to have an upper exterior surface 424 on a radiant energy transparent wall 426 and a lower exterior surface 428. The wall 416 forms a portion of the radiant energy transparent encasing of the collector 414. The tabs 416 extend from the plate 418 such that a free end 430 is at an angle of 90 degrees or less relative to the plate 418. The tabs 416 are in an open position and the single tab 416' is in the closed position. In this case, the total food product will heat at the same rate since the other tabs 416 on the cell 420 are still open. However, if all of the tabs 416 are placed in the closed position (best seen in FIG. 20D) then a food product that is placed adjacent the upper exterior surface 424, above the closed cell 420 will heat slower than food product that is located over open cells.

One or more cell tabs 432 can be twisted to control the radiant energy field within a cell 434 in a collector 436 as illustrated in FIG. 20B. The twisted tabs 432 extend from a plate 438 and, with an open or energy transparent area 440, form the cell 434. The twisted tabs 432 allow radiant energy to escape from the cell 434 into the collector 436 and be transmitted to the cells, which decreases the radiant energy field created by an individual cell. The food product that is positioned adjacent cells 434 having one or more twisted tabs 432 will, therefore, cook at a decreased rate compared to the food product that is positioned adjacent to a cell having no twisted tabs.

The manipulation of individual cells within the radiant energy collector can be utilized to adjust a particular apparatus to a particular type of microwave oven. For example, the cells can be adjusted to be compatible with a particular oven by closing selected cells or by closing a single tab on several individual cells. Closing all of the tabs of a single cell will inhibit that cell from forming a radiant energy field and will shield the food product over that cell. Therefore, the heating power of the radiant energy collector is decreased to a level that is appropriate for a particular type of microwave oven.

Referring to FIG. 20C, a radiant energy collector 442 is illustrated having a plurality of tabs 444, each formed from two bimetallic layers 446 and 448. Again, an opening or energy transparent region 450, formed in a plate 452 from which the tabs 444 are formed, form with the tabs 444 an individual cell 454. In general, these layers function in the same manner as the bimetallic layers 374 and 376, illustrated in FIG. 16. When the collector 442 and hence the tabs 444 are heated, one layer expands more than the other, causing the tabs 444 to bend, and when the tabs cool down to the original temperature, they become substantially straight again. Since the tabs 444 return to substantially the same angle relative to the plate 452 each time the tabs 444 cool, they can be referred to as memory metal tabs. Careful selection of the metal utilized in the bimetallic layers 446 and 448 will produce cells 454 that automatically adjust the energy directional field as the food product heats. For example, choosing metals with coefficients of expansion that force the tab 444 to bend to the closed position (see cell 454' in FIG. 20D) when the food product is uniformly heated will provide a visual indication that the food product is done. In this case, the radiant energy collector 442 will still function as a food warmer and will keep the food product in a uniformly heated state.

Referring to FIG. 21, a conventional microwave oven is designated generally by the reference numeral 460. The conventional microwave oven 460 is constructed with radiant energy reflective interior surfaces, generally metal, such as walls 462 and a floor 464. It has been found that a radiant energy collector is affected by the distance between the cells of the collector and the radiant energy reflective surfaces. For example, improved radiant energy collector performance has been found to occur when the cells are positioned away from the walls 462 of the microwave oven 460 at least ¾ inch. In other words, the performance of the radiant energy collector is improved when none of the cells are located in the area ¾ inch or more from any of the vertical walls 462 of the microwave oven 460.

Additionally, when a radiant energy collector, for example the collector 414, is located on the floor 464 of the microwave oven 460, the optimal distance between the plate 418, located adjacent the upper wall 426, and the lower surface 428 of the radiant energy collector 414 (best seen in FIG. 20A) is approximately 1½ inches. For example, if the tabs 416 were to extend perpendicular to the plate 418 a distance of approximately ¾ inch, the lower surface 428 of the radiant energy collector 414 would be approximately ¾ inch from the free end 430 of the tab 416.

A false floor 466 of microwave transparent material can be utilized to position the wall 426 at a desired distance from a concealed real floor 468 of microwave reflective material. It has been found that by varying the distance between the plate 418 and the microwave reflective floor, in this case the real floor 468, the efficiency of the radiant energy collector 414 can be varied. The heating power of the energy field is most efficient when the cells 420 are positioned at the optimal distance from the radiant energy reflective floor 468 of the microwave oven 460, and this efficiency falls off when the cells 420 are positioned either closer to or farther from the real floor 468. Thus, the floor shape and design can be configured to be compatible with the heating requirements of a specific microwave oven.

Additionally, a food product 470 can be made to heat at different rates by controlling the distance between the plate 418 and the real floor 460. Where a real floor 468' is positioned farther away from the false floor 466, as for example at an area 472, the food product 470 will heat at a slower rate than when the food product 470 is located within the optimal efficiency range. Similarly, a central area 474 that is positioned closer to the false floor 466 will cause the food product 470 to heat at a slower rate than would be the case if the food product 470 were located within the optimal efficiency range. If an area 476 is at an optimal distance, then the area 476 can function to heat the body of the adjacent food product 470 and the areas 472 and 474 can be utilized to keep the adjacent body of food product 470 warm. Therefore, the real floor 468' can be configured to provide different rates or degrees of heating within the single microwave oven 460. As discussed in connection with the tray-shaped apparatus illustrated in FIG. 14, the various heating areas can be color coded to provide a visual indication of the relative heating ability of the area.

A dome or cover member 478 preferably is utilized to cover the food product 470 and the collector 414. The dome 478 is formed from a radiant energy transparent material and is not restricted to a classical dome shape. Rather, the dome is configured so as to be large enough to comfortably cover the food product 472 within the microwave oven 460 and can be large enough to cover both the food product 470 and the collector 414. The dome 478 preferably includes one or more vent openings to allow steam to escape from the dome as in a conventional roasting cover. Although, the dome 478 is not essential to the performance of the improved collectors of the present invention, it has been found that for the most uniform collector heating performance, all of the food product or products 470 in the microwave oven 460 should be covered under a single dome or cover 478. The food product 470 has been found to be heated most uniformly when covered with the dome 478. However, even without the dome 478, the collectors 414 will heat the food product 470 more uniformly than in a conventional microwave oven.

Referring to FIG. 22, a food product container is designated generally by the reference numeral 480. The container 480 is illustrated as a pie plate for example purposes, but is not intended to be restricted to a specific size or shape and can also be in the shape of a tray or a bowl. The container 480 has at least a bottom wall 482 and is shown having a plurality of blocking tab portions 484 interior to the wall 482. However, the blocking tab portions 484 also can be located on or outside of the wall 482. In any case, the tab portion or portions 484, which can be of any shape, must be positioned between the cells (not shown) and the food product (not shown). The tab portion or portions 484 are formed from a radiant energy reflective material and function to shield the food product from the energy field that is formed by the cells. The tab portions 484 are aligned to be over the central open area, such as area 450 in FIG. 20D, such as by designing the container 480 to be in register with the collector, such as the collector 442 in FIG. 20D. It has been found that the areas of food product that are shielded by the tab portions in the container will heat at a faster rate than the unshielded areas. Some food products require increased heat in specific areas of the food product, for example the center of a pie which will generally cook at a slower rate than the edges of the pie. The present invention is particularly useful in that the tab portions 484 can be aligned in those areas where increased heat is desired. It is believed that the tab portions 484 partially block the underlying cells and increase the field of energy applied to the shielded areas of the food product thus heating those areas at a faster rate than the unprotected areas of food product.

Although felt to be undesirable, it has been found that ceramics and certain plastic materials can be utilized to form one or more of the walls of the collectors. The cell plate then is mounted onto the ceramic or plastic wall, which should be of a consistent dimension and material on the order of ⅛ to ¼ inches thick. The ceramic wall appears to elevate and maintain a higher cooking temperature, which allows decreased cooking times and more efficient operating collectors. The plastic materials can include oxides or magnesium and can include metal substrates.

Referring to FIG. 23, a top plan view of a collector 490 is illustrated which includes a central area 492 having a ceramic substrate, to which the cell plate and/or cells are mounted (not illustrated). The collector 490 preferably includes a perimeter spacing portion 494, such as formed from microwave transparent high temperature plastic material. The perimeter portion 494 is ¾ to 1¼ inches wide to provide the desired spacing from the walls of the microwave oven. The collector 490 will operate without the perimeter 494, but operates more efficiently with the perimeter 494 or other spacing from the walls of the microwave unit. The microwaves appear to be activated by the ceramic substrate, which provides the increased cooking temperature.

The central ceramic substrate area 492 further can be enhanced by forming a thin ferrite like layer, such as tin oxide, thereover. The tin oxide, such as provided on ceramic cooking dishes (for example, the Covered Browning Skillet Model MW-A-10, sold by Corning Glass Works of Corning, New York), appears to further enhance and concentrate the microwave energy to further elevate the cooking temperatures of the collector 490. A collector formed like the collector 480, with the same size cells would have at least twice the number of cells to achieve the same type of operation as the collector 490 with the tin oxide coating 496. As illustrated, the coating or layer 496 does not need to be coextensive with the central ceramic portion 492, but can be effective in a smaller central portion.

It has also been determined that the length, width and profile of the tabs affects the performance of the radiant energy collector or of a particular cell. If the tabs are too large, they will block the even distribution of radiant energy fields formed by the cells. The diameter of the cell and the length of the tabs are equally critical. It has been found that short tabs (for example, ¼ inch) as compared to longer tabs (for example ½ inch) will reduce the field strength of a 1⅛ inch diameter cell. Thus, the cells can be adjusted for a specific situation by adjusting the diameter of the cell and the length of the tabs.

The shape of the cells affect the amount of radiant energy reflected from or contained within the cell as well as the strength of the radiant energy field formed by an individual cell. As illustrated in FIG. 24A, it has been found that a generally rounded tab 500 formed from a plate 502 appears to present a very efficient profile in the majority of situations. Another very efficient profile is formed from a polygon shaped tab 504, illustrated in FIG. 24B. The tabs 504 are formed from a plate 506 forming the energy transparent opening, not illustrated. One particularly efficient and easily manufactured collector, has been formed by cutting three of the tabs 504 from each one of a plurality of closely spaced hexagonal shaped cells from the plate 506. The adjacent cells share the tabs 504 to form six tabs for each cell. The plate 506 then is mounted, such as by adhesive to one side of a ceramic substrate and the tin oxide layer is provided on the opposite side of the substrate. However, other tab shapes can be utilized to provide a radiant energy collector that is particularly suited to an individual type of microwave oven or to a radiant energy application other than a microwave oven.

Additionally, the number of cells within a particular radiant energy collector can be adjusted to tailor a radiant energy field to a particular model of microwave oven. In this case, variations in cell size and shape may not be necessary. For example, the optimal number of cells for a 650 watt microwave oven appears to be about 110 cells having a 1-⅛ inch diameter without a ceramic substrate or tin oxide coating. The number of cells can be decreased to half or less that number with both the ceramic substrate and the tin oxide coating. Ideally, these Cells will be located on the floor of the oven so that they are positioned beneath the food product. However, depending on the height of the oven, the walls also can be utilized to provide an optimal number of cells.

Modifications and variations of the present invention are possible in light of the above teachings. It can be appreciated that the periphery of the collectors need not define a perfect geometrical configuration and may or may not include notches necessary for the manufacturing process but not necessary for the proper functioning of the present invention. It is therefore to be understood that within the scope of the appended claims, the invention may be practiced otherwise than as specifically described.

What is claimed and desired to be secured by Letters Patent of the United States is:

1. An improved of controlling the distribution of power within an apparatus for promoting the uniform heating of a food product in a microwave radiant energy field, comprising:

providing an apparatus having a plurality of radiant energy collector cells formed solely by a plurality of tabs mounted to a plate; and controlling the angle of said tabs relative to said plate of at least one of said collector cells to control the degree of heating of the food product located adjacent said collector cell.

2. The method as defined in claim 1 including decreasing the angle of at least one tab of at least one of said collector cells relative to said plate to position said tab substantially coplanar with said plate and close a portion of said collector cell to temporarily increase the field of energy within said cell.

3. The method as defined in claim 2 including positioning all of said tabs on at least one of said collector cells coplanar with said plate to substantially close said cell.

4. The method as defined in claim 1 including forming said tabs from a bimetallic material and including monitoring the movement of said tabs to determine when all of said tabs are positioned coplanar with said plate substantially closing said collector cell and indicating that the food product is uniformly heated.

5. The method as defined in claim 1 further including twisting at least one of said tabs to allow radiant energy to escape from within said collector cell.

6. The method as defined in claim 1 further including providing a microwave unit; and decreasing the angle of at least one tab of at least one of said collector cells relative to said plate to position said tab substantially coplanar with said plate an close a portion of said cell to decrease the field of power within said cell and control the distribution of power within said microwave unit.

7. The method as defined in claim 1 further including controlling the length of said tabs as they extend from said plate and the diameter of each of said collector cells to promote the even distribution of power from the apparatus.

8. The method as defined in claim 1 further including controlling the number and shape of said collector cells to provide optimal performance of said apparatus in connection with a specific microwave unit.

9. The method as defined in claim 1 further providing a microwave oven having vertical walls and a floor; and locating said collector cells on said oven floor so that they are positioned approximately ¾ inch away from said walls.

10. The method as defined in claim 1 further providing a microwave oven having a floor; and locating said apparatus within said oven with said u plate positioned approximately 1½ inches away from said floor.

11. The method as defined in claim 1 further including providing a dome; and covering the food product with said dome to promote the uniform heating of the food product.

12. The method as defined in claim 1 including increasing the thickness gauge of said tabs in a gradient from a heavy gauge located adjacent said plate to a narrow gauge located at a free end of said tab spaced away from said plate.

13. An improved method of controlling the distribution of radiant energy directed to individual areas of a food product to promote the uniform heating of the food product in a radiant energy field, comprising:

providing an apparatus having a plurality of radiant energy collector cells formed by a plurality of tabs mounted to a plate;

providing a radiant energy transparent food product container; and forming and locating at least one blocking tab portion on said food product container such that said blocking tab portion is positioned between the radiant energy source and an individual collector cell of said apparatus to partially screen said collector cell to increase the energy field applied to the individual areas of the food product adjacent said blocking tab portion and cause the screened areas of the food product to heat faster than the unscreened areas of the food product.

14. The method as defined in claim 13 including forming said tab portion interior of a wall of said food product container.

15. The method as defined in claim 13 including forming a plurality of said blocking tab portions, each positioned adjacent one of said collector cells.

16. A radiant energy collector for uniformly heating a food product in the presence of a radiant energy source, comprising:

a substantially radiant energy transparent encasing means having an upper wall, said upper wall having a surface facing interior to said encasing means; and said upper wall including a plurality of collector cells opening on said surface, each of said collector cells having a plurality of tabs surrounding a substantially radiant energy transparent region therebetween and spaced apart from adjacent tabs to prevent arcing in the presence of radiant energy, said tabs further inclined downwardly from said surface under said transparent region at an angle of 90 degrees or less relative to said region to promote the uniform heating of the food product in the presence of the radiant energy source.

17. The collector as defined in claim 16 wherein said collector cells are integral with a plate and said plate is located adjacent said surface of said upper wall with said tabs positioned interior to said radiant energy transparent encasing means.

18. The collector as defined in claim 17 wherein the thickness gauge of said tabs increases in a gradient from a heavy gauge located adjacent said plate to a narrow gauge located away from said plate.

19. The collector as defined in claim 18 wherein said gauge is 0.001 to 0.003 inch.

20. The collector as defined in claim 19 wherein said tabs are coated with a radiant energy transparent material to provide durability.

21. The collector as defined in claim 16 wherein said tabs have a thickness gauge of about 0.009 to 0.010 inch.

22. The collector as defined in claim 16 wherein at least a portion of said upper wall is formed of a ceramic material.

23. The collector as defined in claim 22 wherein said ceramic material forms a central portion of said wall with a perimeter spacing portion therearound.

24. The collector as defined in claim 23 wherein at least a portion of said ceramic central portion is coated with a tin oxide coating.

25. The collector as defined in claim 16 wherein said upper wall is formed of a plastic material.

26. The collector as defined in claim 16 wherein at least one of said tabs is twisted to allow radiant energy to escape from within said collector cell.

27. The collector as defined in claim 16 wherein at least some of said tabs are formed from a bimetallic material.

28. A radiant energy collector in combination with an oven for uniformly heating a food product in a radiant energy heating cavity of said oven, comprising:

an oven having a radiant energy heating cavity, said cavity having walls and a floor;

a substantially radiant energy transparent encasing means having an upper wall, said upper wall having a surface facing interior to said encasing means, said encasing means further adapted to engage said heating cavity; and said upper wall including a plurality of collector cells opening on said surface, each of said collector cells having a plurality of tabs surrounding a substantially radiant energy transparent region therebetween and space apart from adjacent tabs to prevent arcing in the presence of radiant energy, said tabs further inclined downwardly from said surface under said transparent region at an angle of 90 degrees or less relative to said region to promote the uniform heating of the food product in the presence of the radiant energy source.

29. The collector as defined in claim 28 wherein said collector cells are integral with a plate and said plate is located adjacent said surface of said upper wall with said tabs positioned interior to said radiant energy transparent encasing means.

30. The collector as defined in claim 28 further including providing a real radiant energy reflecting floor in said oven, said real floor located beneath a radiant energy transparent false floor.

31. The collector as defined in claim 30 further including areas of said real floor positioned at different distances from said false floor to provide areas above said false floor with different heating efficiencies.

32. The collector as defined in claim 30 wherein said microwave reflective material is metal.

33. The collector as defined in claim 28 further including locating said collector cells approximately $\frac{3}{4}$ inch away from said walls.

34. The collector as defined in claim 28 further including said collector cells positioned within said oven and said upper wall located approximately $1\text{-}\frac{1}{2}$ inches away from said floor.

35. A radiant energy collector for uniformly heating a food product in the presence of a radiant energy source, comprising:

a substantially radiant energy transparent encasing means having an upper wall and a lower wall, each of said walls having surfaces facing interior to said encasing means; and at least one of said walls including a plurality of collector cells opening on said surface, each of said collector cells having a plurality of tabs surrounding a substantially radiant energy transparent region therebetween and spaced apart from adjacent tabs to prevent arcing in the presence of radiant energy, said tabs inclined from said surface to partially block the passage of radiant energy through said region, said tabs further constructed of a material having a thickness gauge that increases in a gradient from a heavy gauge located adjacent said region to a narrow gauge located away from said region to uniformly heat the food product in the presence of the radiant energy source.

36. The collector as defined in claim 35 wherein said collector cells are integral with a plate and said plate is located adjacent at least one of said surfaces facing interior to said encasing means with said tabs positioned interior to said radiant energy transparent encasing means.

37. An improved method of promoting the uniform heating of a food product in the presence of a radiant energy source, comprising:

providing a microwave oven;

providing an apparatus having a plurality of radiant energy collector cells formed solely by a plurality of tabs mounted to a plate, said apparatus further adapted to hold the food on or adjacent to said plate;

providing a dome of radiant energy transparent material sized to fit within said microwave oven; and positioning said dome within said oven to cover the food product and promote the uniform heating of the food product in the presence of radiant energy.

* * * * *

UNITED STATES PATENT AND TRADEMARK OFFICE

CERTIFICATE OF CORRECTION

PATENT NO. : 4,877,933

DATED : October 31, 1989

INVENTOR(S) : Roger A. Yangas

It is certified that error appears in the above-identified patent and that said Letters Patent is hereby corrected as shown below:

Column 2, line 6, "nd" should be "and";

Column 7, line 14, "ca" should be "can";

Column 9, line 67, "SS4" should be "334";

Column 11, line 44, "3S6" should be "336";

Column 12, line 38, "S56" should be "356";

Column 13, line 22, "S41" should be "341";

Column 17, line 35, "460" should be "468";

Column 20, claim 1, line 1, insert "method" after "improved";

Column 20, line 60, delete "u".

Signed and Sealed this

Twenty-fifth Day of September, 1990

*Attest:*

HARRY F. MANBECK, JR.

*Attesting Officer*

*Commissioner of Patents and Trademarks*